US005190274A

United States Patent [19]

Kamamoto et al.

[11] Patent Number: 5,190,274

[45] Date of Patent: Mar. 2, 1993

[54] SHEET TREATMENT DEVICE WITH A VARIABLE TIME PERIOD FOR JAMMING INDICATION

[75] Inventors: Koji Kamamoto, Osaka; Yasuji Yamauchi; Kazutoshi Yamamoto, both of Nara, all of Japan

[73] Assignee: Sharp Kabushiki Kaisha, Osaka, Japan

[21] Appl. No.: 798,231

[22] Filed: Nov. 26, 1991

[30] Foreign Application Priority Data

Nov. 28, 1990 [JP] Japan ..... 2-331467

[51] Int. Cl.[5] ..... B42B 2/00; B65H 39/02

[52] U.S. Cl. ..... 270/53; 270/58

[58] Field of Search ..... 270/52, 53, 58, 37

[56] References Cited

U.S. PATENT DOCUMENTS

| | | | |
|---|---|---|---|
| 5,083,760 | 1/1992 | Yamazaki | 270/53 |
| 5,106,067 | 4/1992 | Higaki | 270/53 |
| 5,112,034 | 5/1992 | Uto et al. | 270/53 |
| 5,129,639 | 7/1992 | DeHority | 270/53 |

FOREIGN PATENT DOCUMENTS

| | | | |
|---|---|---|---|
| 266739 | 5/1988 | European Pat. Off. | 270/53 |
| 119069 | 5/1987 | Japan | 270/53 |
| 290655 | 12/1987 | Japan . | |
| 34864 | 2/1989 | Japan | 270/53 |
| 125790 | 5/1990 | Japan | 270/53 |
| 190396 | 7/1990 | Japan | 270/53 |

*Primary Examiner*—Edward K. Look
*Assistant Examiner*—John Ryznic
*Attorney, Agent, or Firm*—David G. Conlin; Henry D. Pahl, Jr.

[57] ABSTRACT

A sheet treatment device comprises an unit for counting the number of sheets conveyed piece by piece from an image forming device, an unit for binding a plurality of sheets counted by the counting unit, an unit for conveying a set of sheets bound by the binding unit, an unit for setting a time period associated with the number of sheets counted by the counting unit, an unit, which is disposed at a specified position, for detecting passage of the set of sheets conveyed by the conveying unit, and an unit for judging that sheet jamming has occurred in the event that the passage is not detected by the detecting unit within the time period from the time when the set of sheets begins to be conveyed by the conveying unit.

19 Claims, 3 Drawing Sheets

SHEET TREATMENT DEVICE WITH A VARIABLE TIME PERIOD FOR JAMMING INDICATION

BACKGROUND OF THE INVENTION

1. Field of the Invention

The present invention relates to a sheet treatment device for binding sheets having image data printed thereon, which device is convenient when used with an electrophotographic copying apparatus, a facsimile apparatus or the like.

2. Description of the Related Art

A sheet treatment device, which trues up the edges of sheets conveyed from the copier or the like, and staples the sheets and carry out them, is provided with a sensor for detecting jamming which occurs rarely when the bound set of sheets is discharged to the outside of the device.

In such a sheet treatment device, a decision is made that sheet jamming has occurred when a sensor, which is disposed at a specified position, does not detect a bound set of sheets within a predetermined time from start of discharging the set of sheets. However, the time for the discharge differs between a case in which a single sheet is discharged and a case in which a bound set of multiple sheets is discharged collectively. To be exact, the discharge time is dependent on the number of sheets bound together. Therefore, because the predetermined time is fixed in conventional sheet treatment device, jamming cannot be detected correctly.

SUMMARY OF THE INVENTION

It is therefore an object of this invention to provide a sheet treatment device capable of correctly detecting an occurrence of sheet jamming bound together irrespective of the number of sheets.

A sheet treatment device according to the invention comprises an unit for counting the number of sheets conveyed piece by piece from an image forming device, an unit for binding a plurality of sheets counted by the counting unit, an unit for conveying a set of sheets bound by the binding unit, an unit for setting a time period associated with the number of sheets counted by the counting unit, an unit, which is disposed at a specified position, for detecting passage of the set of sheets conveyed by the conveying unit, and an unit for judging that sheet jamming has occurred in the event that the passage of the bound sheets is not detected by the detecting unit within the time period from the time when the set of sheets begins to be conveyed by the conveying unit.

The setting unit may include time data table dependent on the number of sheets, and the time period is determined from the number of sheets with a reference to the time data table.

Preferably the setting unit includes a RAM containing the time data table and the judging unit includes a CPU connected to the detecting unit and the counting unit.

The counting unit may include a sheet sensor for outputting a signal to the CPU when the sheet sensor senses the passage of a sheet, and a counter which is incremented when the CPU receives the output signal from the sheet sensor.

The binding unit may includes a stapler. The binding unit may further include an unit for truing up the edges of sheets.

In a preferred embodiment the conveying unit include a gate for controlling start time of discharging a set of sheets to the outside of the sheet treatment device, and a carry-out path for guiding the bound sheets from the gate. The detecting unit may include a sheet sensor disposed in the carry-out path.

In operation, sheets carried out from the picture image forming device, such as a copier, are sequentially sent to the sheet treatment device for sheet.

After sheets are counted by the counting unit, they are bound together by the binding unit. Then, the bound sheets is brought to the outside of the sheet treatment device by the conveying unit, and the passage of the bound sheets is detected by the detecting unit disposed in the conveying unit. At this time, if the bound sheets does not pass through within a predetermined time preset by the setting unit, the judging unit judges that sheet jamming has occurred.

Thus, the sheet treatment device according to the present invention determines that sheet jamming has occurred if detection is not made that the bound sheets have reached a specified position within a period of time associated with the number of bound sheets to be conveyed to the outside, and therefore, can correctly notify an occurrence of sheet jamming at all times irrespective of the number of sheets bound together.

Further objects and advantages of the present invention will be apparent from the following description of the preferred embodiments of the invention as illustrated in the accompanying drawings.

DESCRIPTION OF THE PREFERRED EMBODIMENTS

An embodiment of a sheet treatment device according to the present invention will be described in detail hereinafter with reference to the accompanying drawings.

Figure 1:
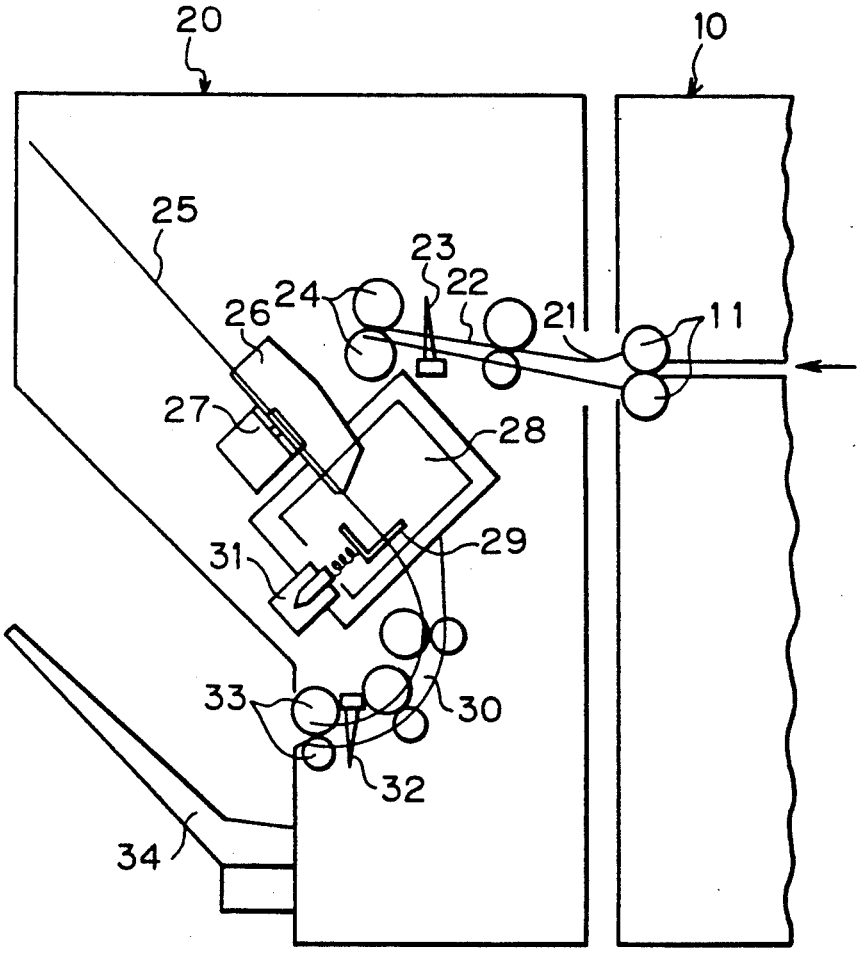
FIG. 1 is a vertical cross-sectional view of a sheet treatment device.

FIG. 1 shows the construction of the sheet treatment device 20 according to the present invention. Sheets (not shown) onto which images have been transferred by a copier are conveyed piece by piece in the arrow direction by conveying rollers 11.

In FIG. 1, reference numeral 21 denotes a sheet inlet for receiving sheets discharged from the copier 10, 22 denotes a path, 23 denotes a sheet sensor, 24 denotes rollers for conveying a sheet to a tray 25, 26 denotes an aligning unit for truing up the edges of sheets placed on the tray 25, 27 denotes a motor for driving the aligning unit 26, and 28 denotes a stapling unit.

Reference numeral 29 indicates a gate for keeping the position of sheets during the operation of the stapling unit 28 and controlling the start of discharging stapled sheets through a transfer path 30 to the outside of the sheet treatment device and when this gate is pulled upwards by a solenoid 31, the stapled sheets are carried into the transfer path 30.

Reference numeral 32 indicates a sheet sensor for detecting sheet jam, and 33 indicates sheet rollers for discharging stapled sheets, which is conveyed through the transfer path 30, to a sheet tray 34.

Figure 2:
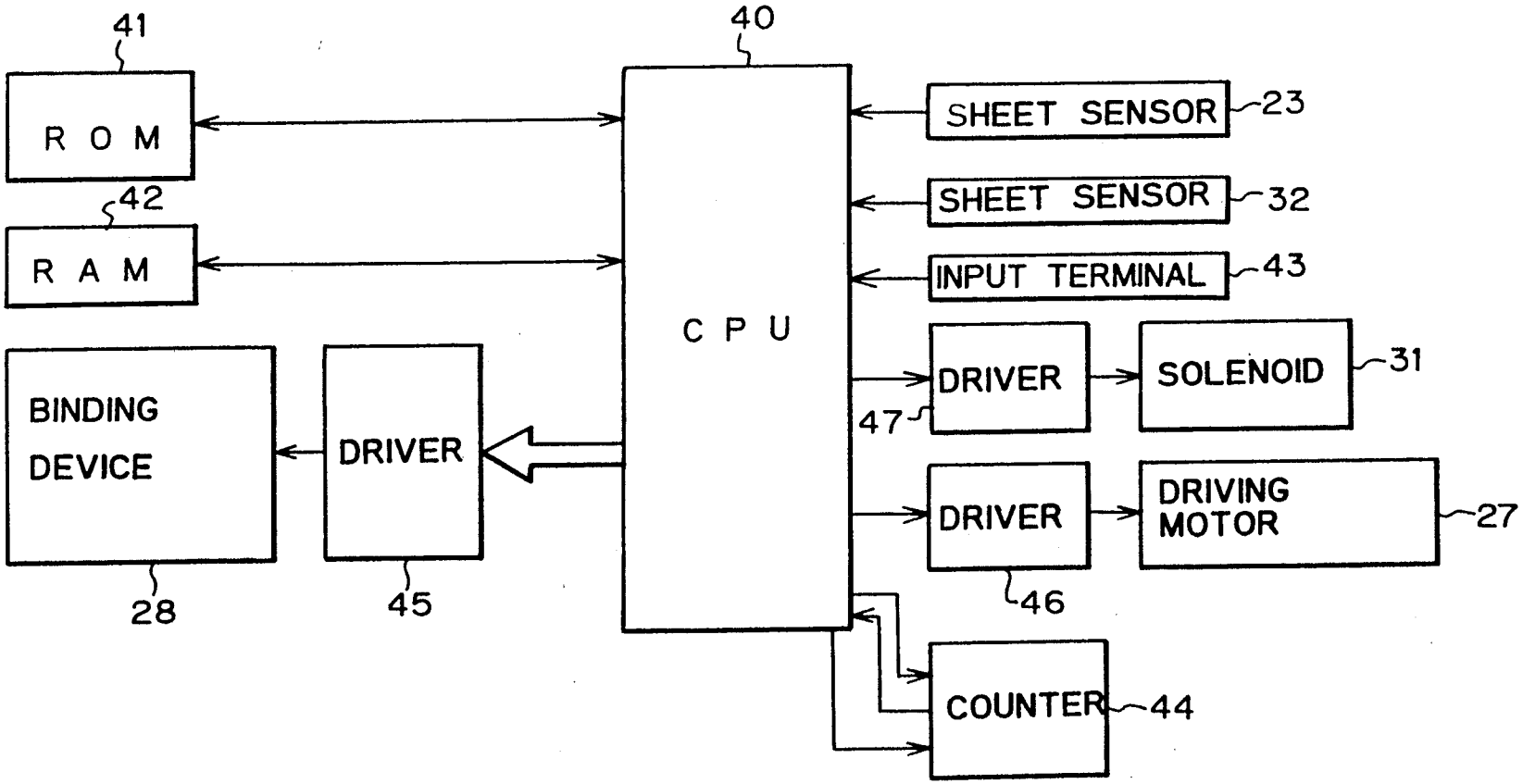
FIG. 2 is a block diagram of the control circuit of the sheet treatment device.

FIG. 2 is the block diagram of the control circuit by the above-mentioned sheet treatment device.

In FIG. 2, reference numeral 40 indicates a CPU (central processing unit), and 41 is a ROM (read only memory) for storing control programs and time data associated with the number of sheets as the basis for judging whether or not sheet jamming has occurred. Reference numeral 42 indicates a RAM (random access memory) for temporarily storing data such as the number of original sheets and the number of copies, which are set through an input unit 43. Reference numberal 44 denotes a counter for counting sheets sent from the copier 10 by means of output signals form the sheet sensor 23, while 45, 46 and 47 denote drivers for the stapling unit 28, the motor 27 and the solenoid 31.

Figure 3:
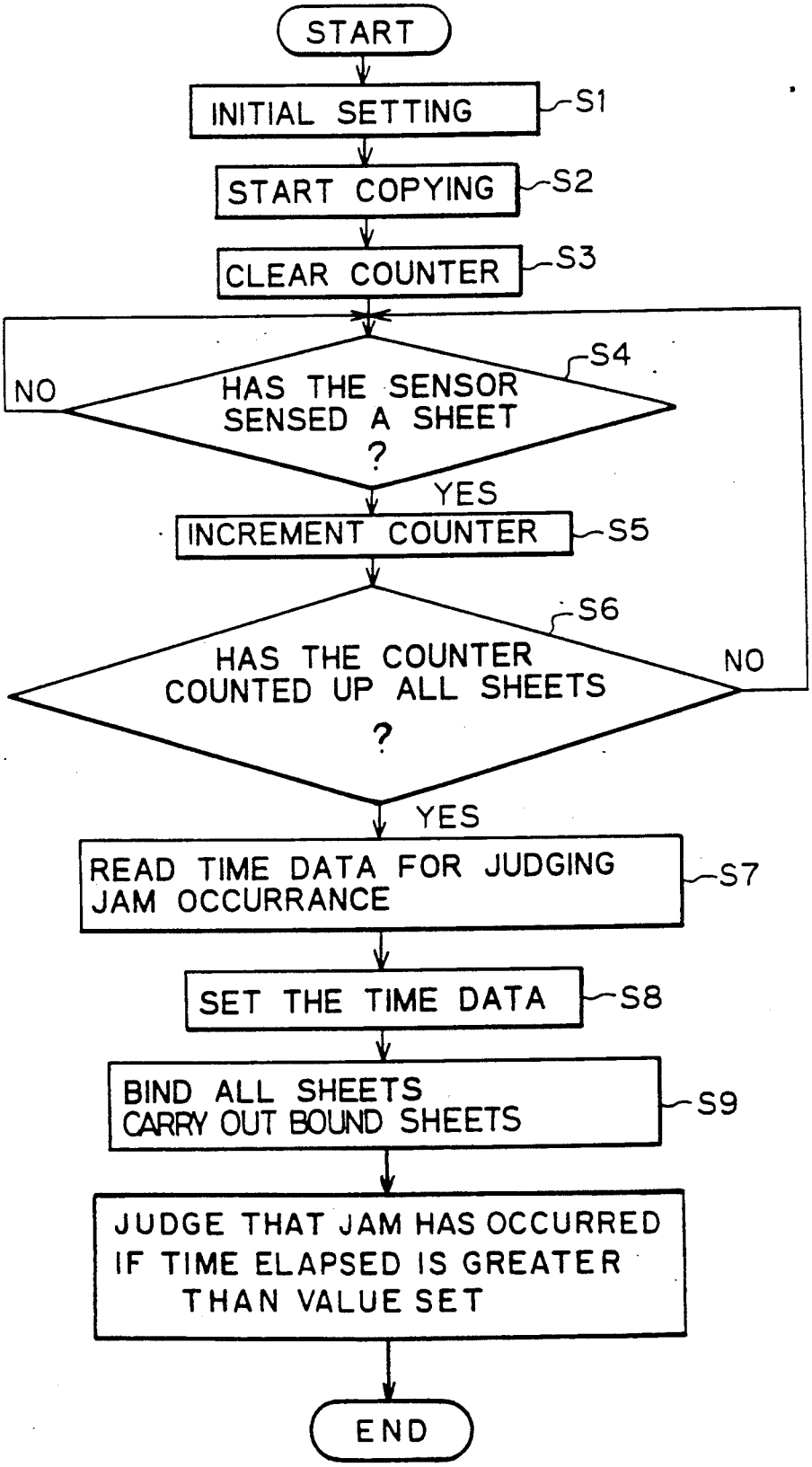
FIG. 3 is a flowchart for explaining the operation of the sheet treatment device.

With reference to FIG. 3, the operation of the sheet treatment device according to the above-mentioned embodiment is described hereinafter.

After first step S1, the device is initialized, at the next step S2, various setting data, such as the number of original sheets and the number of copies set through the input unit 43 are stored in the RAM 42, and when a copy start button is pressed, the program proceeds to step S3. At step S3, the counter 44 is cleared, and at step S4, a decision is made whether or not a sheet has been detected by the sheet sensor 23. If the sensor has detected a sheet, the program moves on to step S5 where the counter 44 is incremented.

Then, at step S6, the count on the counter 44 is compared with the number of originals, and if they do not coincide with each other, the program goes back to step S4, and if they coincide, the program advances to step S7. At step S7, the time data associated with the number of the stapled sheets on the tray 25 is read from the ROM 41. At step S8, a reference time for judging sheet jamming is updated to the time data read out at the step S7.

At step S9, binding (or stapling) and discharging processes are executed by controlling the binding unit 28, the aligning unit 26, the solenoid 31, and the sheet rollers 33. When the sheet sensor 32 does not detect the stapled sheets within the time period set at the step S8, a decision is made that sheet jamming has occurred.

Thus, the sheet treatment device according to the present invention sets time data associated with the number of sheets and determines that sheet jamming has occurred if detection is not made that the stapled sheets have reached a specified position within a period of time associated with the number of sheets to be conveyed to the outside, and therefore, can correctly notify an occurrence of sheet jamming at all times irrespective of the number of sheets bound together.

Many widely different embodiments of the present invention may be constructed without departing from the spirit and the scope of the present invention. It should be understood that the present invention not be limited to the specific embodiments described in the specification, except as defined in the appended claims.

What is claimed is:

1. A sheet treatment device for sheets conveyed from an image forming device, comprising:

means for counting the number of sheets conveyed piece by piece from said image forming device;

means for binding a plurality of sheets counted by said counting means;

means for conveying a set of sheets bound by said binding means;

means for setting a time period which is variable as a function of the number of sheet counted by said counting means;

means disposed at a specified position, for detecting passage of the set of sheets conveyed by said conveying means; and means for judging that sheet jamming has occurred in the event that the passage of the bound sheets is not detected by said detecting means within said time period from the time when the set of sheets begins to be conveyed by said conveying means.

2. A sheet treatment device for sheets conveyed from an image forming device, comprising:

means for counting the number of sheets conveyed piece by piece from said image forming device;

means for binding a plurality of sheets counted by said counting means;

means for conveying a set of sheets bound by said binding means;

means for determining a time period from the number of sheets, which is counted by said counting means, of the set conveyed by said conveying means with reference to a time data table including time data dependent on a number of sheets;

means disposed at a specified position, for detecting passage of the set of sheets conveyed by said conveying means; and means for judging that sheet jamming has occurred in the event that the passage of the bound sheets is not detected by said detecting means within said time period from the time when the set of sheets begins to be conveyed by said conveying means.

3. A sheet treatment device according to claim 2, wherein said sheet treatment device includes a RAM containing said time data table.

4. A sheet treatment device according to claim 3, wherein said judging means includes a CPU connected to said counting means and said detecting means.

5. A sheet treatment device according to claim 4, wherein said counting means includes a sheet sensor for outputting a signal to said CPU when said sheet sensor senses the passage of a sheet, and a counter which is incremented when it receives said output signal from said sheet sensor.

6. A sheet treatment device according to claim 5, wherein said binding means includes a stapler.

7. A sheet treatment device according to claim 6, wherein said binding means includes means for truing up the edges of sheets.

8. A sheet treatment device according to claim 7, wherein said conveying means includes a gate for controlling start time of discharging a set of sheets to the outside of said sheet treatment device, and a carry-out path for guiding bound sheets from said gate.

9. A sheet treatment device according to claim 8, wherein said detecting means includes a sheet sensor disposed in said carry-out path.

10. A sheet treatment device according to claim 9, wherein said sheet treatment devices further includes means for feeding a plurality of sheets sequentially conveyed from the image forming device to said counting means and said binding means.

11. A sheet treatment device for sheets, on which copy images of originals are formed respectively by an image forming device, comprising:

means for counting the number of sheets conveyed piece by piece from said image forming device;

means for binding a plurality of sheets counted by said counting means;

means for enabling said binding means when the number of sheets counted by said counting means is equal to the number of originals;

means for conveying a set of sheets bound by said binding means;

means for determining a time period on the basis of the number of sheets of the set conveyed by said conveying means with reference to a time data table including time data dependent on a number of sheets;

means disposed at a specified position, for detecting passage of the set of sheets conveyed by said conveying means; and means for judging that sheet jamming has occurred in the event that the passage of the bound sheets is not detected by said detecting means within said time period from the time when the set of sheets begins to be conveyed by said conveying means.

12. A sheet treatment device according to claim 11, wherein said sheet treatment device includes a RAM containing said time data table.

13. A sheet treatment device according to claim 12, wherein said judging means includes a CPU connected to said counting means and said detecting means.

14. A sheet treatment device according to claim 13, wherein said counting means includes a sheet sensor for outputting a signal to said CPU when said sheet sensor senses the passage of a sheet, and a counter which is incremented when it receives said output signal from said sheet sensor.

15. A sheet treatment device according to claim 14, wherein said binding means includes a stapler.

16. A sheet treatment device according to claim 15, wherein said binding means includes means for truing up the edges of sheets.

17. A sheet treatment device according to claim 16, wherein said conveying means includes a gate for controlling start time of discharging a set of sheets to the outside of said sheet treatment device, and a carry-out path for guiding bound sheets from said gate.

18. A sheet treatment device according to claim 17, wherein said detecting means includes a sheet sensor disposed in said carry-out path.

19. A sheet treatment device according to claim 18, wherein said sheet treatment devices further includes means for feeding a plurality of sheets sequentially conveyed from the image forming device to said counting means and said binding means.

* * * * *

UNITED STATES PATENT AND TRADEMARK OFFICE

CERTIFICATE OF CORRECTION

PATENT NO. : 5,190,274

DATED : March 2, 1993

INVENTOR(S) : Koji Katamoto, Yasuji Yamauchi, Kazutoshi Yamamoto

It is certified that error appears in the above-identified patent and that said Letters Patent is hereby corrected as shown below:

On the title page, Item [19] and Item [75] - Inventors: correct the Last Name of Koji Kamamoto to read Koji Katamoto.

Signed and Sealed this

Sixteenth Day of November, 1993

Bruce Lehman

*Attest:*

BRUCE LEHMAN

*Attesting Officer*

*Commissioner of Patents and Trademarks*